US007639203B2

(12) United States Patent
Hao

(10) Patent No.: US 7,639,203 B2
(45) Date of Patent: Dec. 29, 2009

(54) SPIRAL COIL LOADED SHORT WIRE ANTENNA

(75) Inventor: Jin Hao, Fox Point, WI (US)

(73) Assignee: Badger Meter, Inc., Milwaukee, WI (US)

( * ) Notice: Subject to any disclaimer, the term of this patent is extended or adjusted under 35 U.S.C. 154(b) by 23 days.

(21) Appl. No.: 12/127,163

(22) Filed: May 27, 2008

(65) Prior Publication Data

US 2009/0015512 A1 Jan. 15, 2009

Related U.S. Application Data

(60) Provisional application No. 60/959,563, filed on Jul. 13, 2007.

(51) Int. Cl.
*H01Q 1/36* (2006.01)

(52) U.S. Cl. ..... 343/895; 343/719; 343/745

(58) Field of Classification Search ..... 343/719, 343/866, 867, 895, 745
See application file for complete search history.

(56) References Cited

U.S. PATENT DOCUMENTS

| | | | | |
|---|---|---|---|---|
| 2,850,732 | A * | 9/1958 | Altoonian et al. | 343/752 |
| 4,137,534 | A * | 1/1979 | Goodnight | 343/752 |
| 6,239,753 | B1 * | 5/2001 | Kado et al. | 343/702 |
| 2003/0227422 | A1 * | 12/2003 | Berry et al. | 343/895 |
| 2007/0247380 | A1 * | 10/2007 | Borleske et al. | 343/719 |

* cited by examiner

*Primary Examiner*—Tho G Phan
(74) *Attorney, Agent, or Firm*—Boyle Fredrickson, S.C.

(57) ABSTRACT

A antenna (10) comprises a straight stem portion (11) and a spiral coiled portion (12) for providing the necessary length, but being compact enough for assembly in a pit tube (23) of a transmitter assembly (20) for subsurface enclosures for fluid meters.

14 Claims, 2 Drawing Sheets

SPIRAL COIL LOADED SHORT WIRE ANTENNA

CROSS-REFERENCE TO RELATION APPLICATION

The benefit of priority based on U.S. Provisional Appl. No. 60/959,563, filed Jul. 13, 2007, is claimed herein.

BACKGROUND OF THE INVENTION

The invention relates to automatic meter reading (AMR) systems with radio transmitters or transceivers distributed in the field to receive metering signals and to transmit them to reader devices. In particular the invention is applied to systems where the meters and transmitters are disposed in subsurface enclosures, also know as "pit" enclosures.

In automatic meter reading (AMR) systems, one embodiment of the prior art comprises: a printed circuit board, the battery and an antenna which are held together in a short plastic tube and encapsulated. The antenna assembly is then placed into a metal-walled pit with a metal or plastic cover. When installed in a subsurface pit installation, the antenna is at the level of the ground plane and projects slightly above the plastic or metal cover through a hole in the cover. Antenna radiation is strongly limited by the metal wall and especially a metal cover. In this situation, the antenna's size is strictly confined but high radiation efficiency and a high gain for the antenna are required.

For electrically small antenna design, the uniform current distribution on the wire and the wire length meeting resonance condition are basic requirements to obtain high gain. Abrupt bending and zigzags decrease efficiency of small antennas as explained in W. L. Stutzman, and G. A. Thiele, *Antenna Theory and Design*, New York: J. Wiley & Sons, 2003 and R. S. Elliott, *Antenna Theory and Design*, New York: J. Wiley & Sons, 1998.

SUMMARY OF THE INVENTION

The invention relates to an antenna and to an antenna assembly for particular use in meter reading networks.

The antenna includes an elongated member having a total length of approximately 0.277λ, where λ corresponds to a frequency, f, in a range from 450 MHz to 470 MHz, the elongated member having a straight stem part comprising about 20% of the total length and a coiled upper part of about 80% of the total length, the upper part being coiled in a spiral pattern.

The antenna is assembled with a ground plane and a portion of conductor connecting the antenna through the ground plane to circuitry beneath the ground plane, preferably providing at least a transmitter for radiating radio signals in the selected frequency band through the antenna. The radio signals carry meter data information to a receiver in an AMR (automatic meter reading) network.

The antenna, the ground plane and transmitter circuitry are disposed in a hollow stem of a housing of a type used in subsurface meter pit installations.

Other objects and advantages of the invention, besides those discussed above, will be apparent to those of ordinary skill in the art from the description of the preferred embodiments which follows. In the description, reference is made to the accompanying drawings, which form a part hereof, and which illustrate examples of the invention.

DETAILED DESCRIPTION

Figure 1:
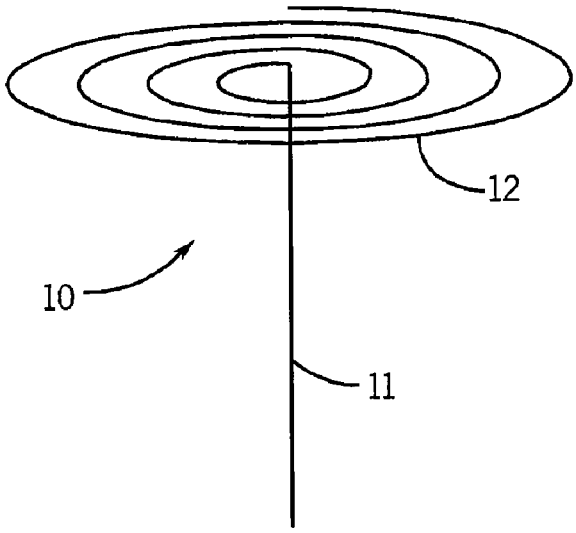
FIG. 1 is a schematic perspective diagram of an antenna of the present invention.

The present antenna 10 of FIG. 1 is formed of a wire slightly longer than a quarter-wave length to be the total length of the antenna to meet the resonance condition. The main radiation straight wire 11 is approximately ½₀λ long, on which the current distribution is the top of the sinusoidal distribution and close to flat. All other "spare" wire is spiraled into a coil 12 to save space. It is interesting that the "spare wire" is also a part of the antenna 10. A difference from the straight wire radiator 11, which is vertically polarized, is that the spiral coil 12 is vertically polarized for magnetic field, or horizontally polarized for electrical field. Thus, this antenna has dual polarization. Without too many bends and zigzags, this antenna 10 has relatively high efficiency and gain.

This antenna is preferred for use in a frequency band from f=450 MHz to f=470 MHz, and thus f=460 MHz is the center frequency, although it might be applied to other frequency bands as well. FIG. 1 shows the profile of the antenna 10.

The total length of the wire in FIG. 1 is 181 mm and is approximately 0.277λ. As the main radiator, the straight wire part 11 is 33 mm long, the "spare" part of the 148 mm long wire is then spiraled into a coil 12, which is the load of the wire antenna and the other part of the antenna itself.

Figure 2:
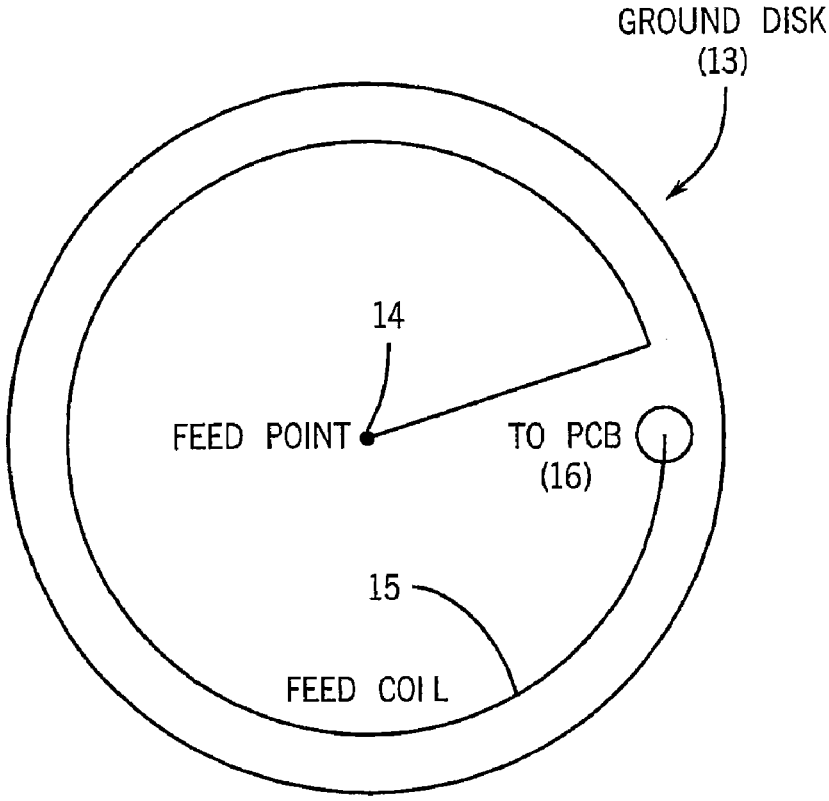
FIG. 2 is a plan view schematic diagram of a feedthrough connection of the antenna of FIG. 1 through a ground element.

FIG. 2 is the feed arrangement. The RF feedthrough opening 16 is located above the top side of the PCB 24, and the antenna is fed by a full circle coil 15 (or any length of arc wire or even a straight wire) above a disk 13 acting as a ground plane. In FIG. 2, the diameter of the conductive disk 13 (ground plane) is 34 mm. The height of the feed arc wire 15 above the ground disk 13 is approximately 2 mm. The distance from the hole 16 in the ground disk 13 to the center 14 is 14 mm.

Using NEC wire antenna simulation software, a 3.16 dB gain from spiral-coil loaded wire antenna and a 2.64 dB gain from a quarter wave monopole antenna without ground plane were obtained, 2.64 dB gain is also close to 2.15 dB for a half-wave dipole antenna according to W. L. Stutzman, and G. A. Thiele, *Antenna Theory and Design*, New York: J. Wiley & Sons, 2003.

The feed coil 15 in FIG. 2 can be treated as a piece of microstrip transmission line. Different coil lengths result in different input impedance, therefore, the length of the coil can meet various antenna environments (printed circuit board, box etc.). To fully understand the matching impedance characteristics, three different feed coils were designed: A represents straight wire feed (no coil at all); B, quarter circle feed coil; C, full feed coil as seen in FIG. 2. Although these three examples are given, it is possible to have the feed coil extend any length between zero and a full circle around the ground plane. In testing, the power radiates from this spiral antenna. Another monopole was used to pick up signal from about 45 cm away from the spiral antenna. The receiving monopole is parallel to the short straight wire of the spiral antenna to have them polarization matched. Since all these antennas have a donut-shaped pattern and a frequency range that is narrow band, the received power may represent relative antenna gain and matching property. VSWR and $S_{21}$ parameters were obtained by using a HP analyzer.

Table I presents some test results for a straight through (no loop) wire feed (A), a quarter loop feed coil (B) and a full loop feed coil (C) arrangement. From the results, it seems that the antenna (C) with a full circle feed coil inherently matches the 50 Ω line.

TABLE I

MEASUREMENT RESULTS

| | VSWR | Zin (Ω) | Power (dBm) |
|---|---|---|---|
| A | 11.5 | 22 - j 105 | −35.0 |
| B | 7.0 | 20 - j 66 | −31.0 |
| C | 1.5 | 35 - j 8.5 | −28.0 |
| Monopole | 4.8 | 13 - j 24 | −30.0 |

Figure 3:
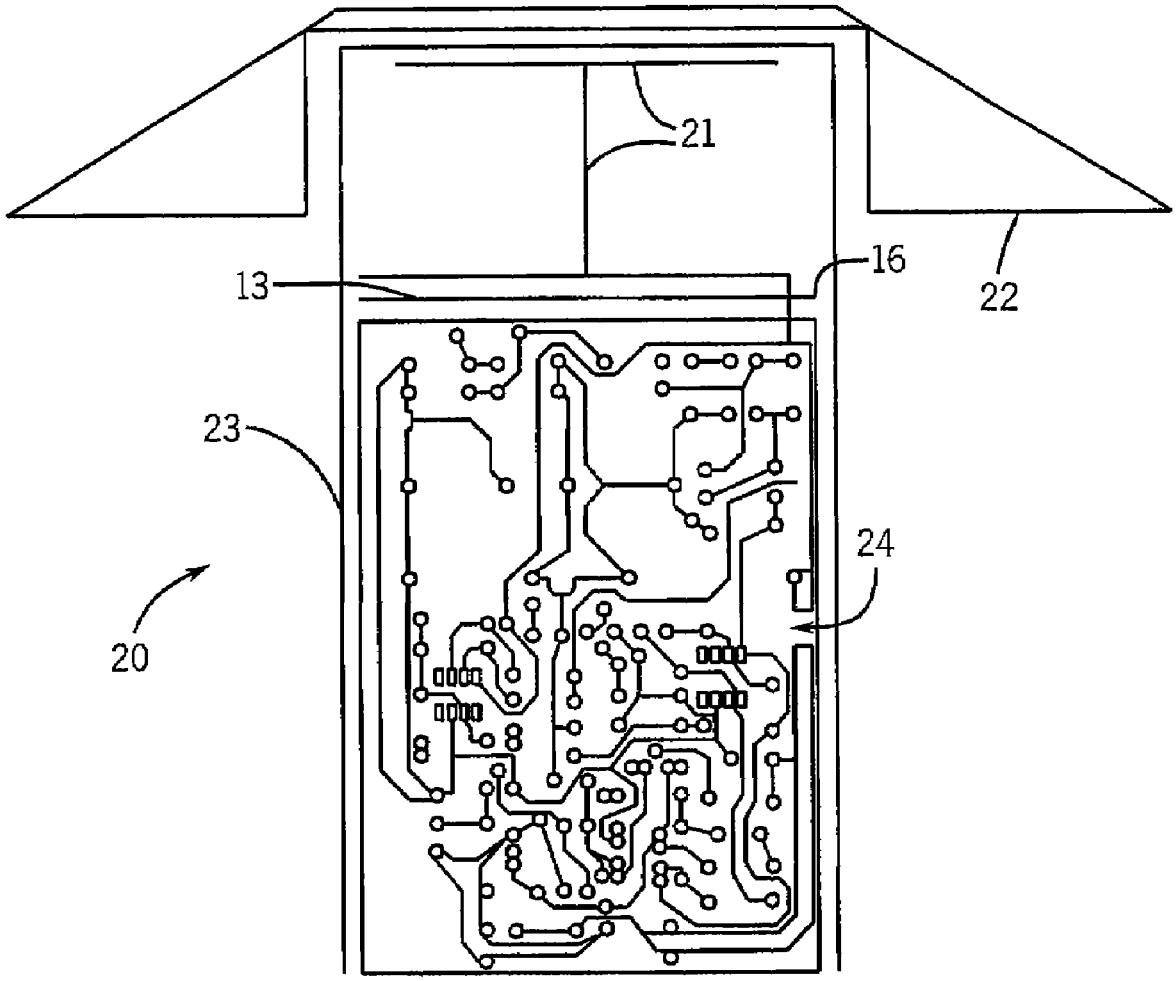
FIG. 3 is a schematic view in elevation of an assembly that incorporates the components of FIGS. 1 and 2.

When this antenna part of a water meter transmitter assembly unit, the antenna assembly 20 (PCB 24, dielectric tube 23, etc) becomes part of the new antenna 21, and therefore the antenna gain and the input impedance will be changed. The entire unit 20 including antenna 21 is shown in FIG. 3.

It was noticed that when the antenna 21 and PCB 24 are placed into the dielectric tube 23, the tube 23 adds an equivalent inductance to the antenna input impedance. The cap 22, which is made by the same dielectric material as the tube 23, increases the inductance to antenna's input impedance. The tube 23 is suspended from the cap 22 into the pit enclosure cavity. The cap 22 rests on top of a lid of the pit enclosure and the components 22, 23 can be connected by a threaded connection. In this situation, the full feed coil structure impedance is non-matching and the received power drops. By measurement, the quarter circle feed coil inherently matches the unit at this situation. However, the unit must be encapsulated in dielectric material. The unit will become solid and combine antenna, PCB and tube firmly. Thus, the quarter circle feed arrangement mismatches again in impedance. It is interesting that the potting material adds to the antenna's inductance too. Consequently, a straight wire feed arrangement matches the unit inherently. Test results are shown in Table II. It should be noted that in table I, all results are from bald antennas and in table II, A and B represent antenna with realistic units, which can be treated as part of the antenna.

TABLE II

MEASUREMENT RESULTS FOR ANTENNA IN THE UNIT

| | Not Potted | | Potted | |
|---|---|---|---|---|
| | VSWR | Power (dBm) | VSWR | Power (dBm) |
| A | 1.8 | −27.0 | 1.3 | −25.0 |
| B | 4.3 | −31.0 | 4.5 | −27.0 |

Theoretically, the antenna must still be matched in impedance to the final environment (metal wall, earth, plastic cover etc.). However, since the existing pit products use different-shaped walls and covers, the matching to all types of surrounding apparatus would require a further type of adjustment feature. By measuring, we found that various surrounding mismatch VSWR of the antenna to about 2.0 and power decreases approximately 1 dBm.

Field tests were conducted. We put the antenna with the entire unit into a metal-walled pit with plastic cover. A receiver with a 2-element array dipole antenna was mounted on the top of a 24 foot pole. In urban areas, approximately −100 dBm power was received at a location 0.5 mile away from the unit, −105 dBm power was received 1.0 mile apart from the transmitter. In an abandoned airfield area, −110 dBm power from 1 mile apart and −113 dBm power from 1.5 miles away from the unit were received. Replacing the plastic cover by metal cover, −110 dBm power was received 1 mile away from the unit in the airfield environment. The signal disappeared 1.5 miles away from the transmitter. The data obtained above are only reference points due to fading and complicated environmental conditions.

In summary, a spiral coil loaded short wire antenna for AMR transmitters has been developed. The arrangement utilizes the maximum current part of the wire to be the main radiating part. The top part of the wire is spiraled to save space and to be the load of the straight wire radiator, while the load itself is the other part of the antenna. The antenna has a relatively high gain and can meet various matching situations. Its gain is at the same level of a quarter-wavelength monopole without ground plane. It provides a dual polarized radiation and a donut-shaped pattern with different feed arrangements. The antenna's structure is very simple and easy to manufacture. The cost is low because the antenna is made of a piece of wire and a small metal disk. The antenna is applicable to AMR systems and other wireless communication systems. It can also be utilized as elements of array antennas because of its small and simple structure and good performance.

I claim:

1. An antenna comprising an elongated member having a total length of approximately 0.277λ, where λ corresponds to a frequency, f, in a range from about 450 MHz to about 470 MHz, the elongated member having a straight stem part comprising about 20% of the total length and providing a main radiating element and the elongated member having a coiled upper part of about 80% of the total length, the upper part being coiled in a spiral pattern; and further comprising means at a lower end of the straight stem part for tuning the antenna to a resonant frequency.

2. The antenna of claim 1, wherein the elongated member is a wire.

3. The antenna of claim 1, in combination with a ground plane disposed near a lower end of the antenna.

4. The antenna of claim 3, wherein the means for tuning at the lower end of the straight stem part is further connected through a connection through the ground plane to circuitry disposed below the ground plane.

5. The antenna of claim 4, wherein the means for tuning includes a coil disposed on the ground plane, the coil extending for a full circle around the ground plane at a radial distance from a center of the ground plane.

6. The antenna of claim 4, wherein the means for tuning includes a portion of a coil disposed on the ground plane, the portion extending for one quarter circle around the ground plane.

7. The antenna of claim 4, 5 or 6, wherein the connection is a connection straight through the ground plane at a distance from the center of the ground plane.

8. An assembly for positioning in a subsurface enclosure for transmitting radio signals carrying meter data information, the assembly comprising:

a housing;

a component for suspending the housing from a top portion of the subsurface enclosure;

an antenna comprising an elongated member having a total length of approximately 0.277λ, where λ corresponds to a frequency, f, in a range from about 450 MHz to about 470 MHz, the elongated member having a straight stem part comprising about 20% of the total length and providing a main radiating element and the elongated member having a coiled upper part of about 80% of the total length, the upper part being coiled in a spiral pattern; and further comprising means at a lower end of the straight stem part for tuning the antenna to a resonant frequency.

9. The assembly of claim 8, wherein the housing is cylindrical.

10. The assembly of claim 8, in combination with a disk-shaped ground plane disposed near a lower end of the antenna.

11. The assembly of claim 10, wherein the means for tuning at the lower end of the straight stem part includes a connection feeding through the disk-shaped ground plane to circuitry disposed below the ground plane.

12. The assembly of claim 10, wherein the means for tuning at the lower end of the straight stem part includes a coil disposed on the ground plane, the coil extending for a full circle around the ground plane at a radial distance from a center of the ground plane.

13. The antenna of claim 10, wherein the means for tuning at the lower end of the straight stem part includes a portion of a coil disposed on the ground plane, the portion extending for one quarter circle around the ground plane.

14. The antenna of claim 11, 12 or 13, wherein the connection is a connection straight through the ground plane at a distance from the center of the ground plane.

* * * * *